US010506853B2

(12) United States Patent
Bazin et al.

(10) Patent No.: US 10,506,853 B2
(45) Date of Patent: Dec. 17, 2019

(54) WATCH STRAP

(71) Applicant: The Swatch Group Research and Development Ltd, Marin (CH)

(72) Inventors: Jean-Luc Bazin, Tuscherz-Alfermee (CH); Francois Maire, Bienne (CH); Jean-Claude Gracia, Morigen (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/640,759

(22) Filed: Jul. 3, 2017

(65) Prior Publication Data

US 2018/0008017 A1 Jan. 11, 2018

(30) Foreign Application Priority Data

Jul. 6, 2016 (EP) ..... 16178235

(51) Int. Cl.
*G04B 37/14* (2006.01)
*A44C 5/16* (2006.01)
*A44C 5/00* (2006.01)

(52) U.S. Cl.
CPC ..... *A44C 5/16* (2013.01); *A44C 5/0069* (2013.01); *G04B 37/1486* (2013.01)

(58) Field of Classification Search
CPC ..... G04B 37/1486; A44C 5/14; A44C 5/16; A44C 5/147
USPC ..... 24/71 T, 265 WS
See application file for complete search history.

(56) References Cited

U.S. PATENT DOCUMENTS 1,326,934 A * 1/1920 Hulburd ..... G04B 37/1486 368/281
1,760,689 A * 5/1930 Domler ..... A44C 5/14 224/176
1,760,913 A * 6/1930 Otten ..... A44C 5/14 24/265 WS (Continued)

FOREIGN PATENT DOCUMENTS

CH 121321 7/1927
CH 622 690 4/1981

(Continued)

OTHER PUBLICATIONS

European Search Report dated Dec. 22, 2016 in European application 16178235.4, filed on Jul. 6, 2016 (with English Translation of Categories of Cited Documents).

*Primary Examiner* — Sean P Kayes
(74) *Attorney, Agent, or Firm* — Oblon, McClelland, Maier & Neustadt, L.L.P.

(57) ABSTRACT

Watch comprising at least one case and a strap formed by a flexible blade with a first end fixed to the case and a second opposite end provided to cooperate with a device for attaching and adjusting the length of the strap. According to the invention, the adjustment device comprises a clasp formed by a cap and a lever between which the flexible blade slides, the clasp being hinged on the case by linking means which define an axis of rotation about which the lever can undergo a rotation in order to be able to move into an open position and into a closed position, the lever comprising an eccentric which is integral with the lever in the vicinity of the axis of rotation and is provided in order to clamp the free end of the blade against the cap and to retain the strap when the lever is in the closed position.

7 Claims, 1 Drawing Sheet

(56) References Cited

U.S. PATENT DOCUMENTS

| | | | | | |
|---|---|---|---|---|---|
| 2,148,585 | A * | 2/1939 | Schlesinger | A44C 5/14 | 24/170 |
| 3,685,107 | A * | 8/1972 | Epiard | A44C 5/14 | 24/601.7 |
| 3,889,323 | A * | 6/1975 | Reith | A44C 5/14 | 224/177 |
| 3,908,243 | A * | 9/1975 | Lou | A44C 5/14 | 24/653 |
| 5,974,633 | A * | 11/1999 | Sartor | A43C 11/1406 | 24/68 SK |
| 9,775,410 | B2 * | 10/2017 | Szewczyk | A44B 11/125 | |
| 10,060,700 | B2 * | 8/2018 | Gellert | F41C 33/002 | |
| 2010/0302914 | A1 | 12/2010 | Faucher et al. | | |
| 2011/0113594 | A1 * | 5/2011 | Kaltenrieder | A44C 5/14 | 24/265 WS |
| 2013/0223195 | A1 | 8/2013 | Loetscher | | |

FOREIGN PATENT DOCUMENTS

| | | |
|---|---|---|
| EP | 2 630 887 A1 | 0/2016 |
| FR | 2 754 615 | 4/1998 |
| GB | 266 086 | 3/1927 |
| JP | 54-97163 U | 7/1979 |
| JP | 2-46808 | 2/1990 |

* cited by examiner

WATCH STRAP

This application claims priority from European Patent Application No. 16178235.4 filed on Jul. 6, 2016; the entire disclosure of which is incorporated herein by reference.

FIELD OF THE INVENTION

The invention relates to a watch provided with a strap comprising, between a first end and a second opposite end, a device for attaching and adjusting the strap.

The invention relates to the field of equipment fixed on the human body, in particular equipment for measuring the time, such as watches.

BACKGROUND OF THE INVENTION

Straps, and especially watch straps, are generally of dimensions adjusted to the morphology of the user. The adjustment ranges are limited. Few straps offer possibilities for fast slipping on or taking off, whilst ensuring good adjustment and good retention during utilisation when worn.

Traditional clasps require gentle handling, whether it concerns a pin buckle or even deployant buckle mechanisms. In particular, handling with gloves is impossible. These clasps are expensive in addition and generally include blunt protruding parts.

Straps produced entirely in elastic material do not always ensure good retention, in particular when the user, for example a sportsman, subjects his watch or his strap to high acceleration.

SUMMARY OF THE INVENTION

The object of the invention is to perfect a watch equipped with a strap which has no clasp in the normal sense of the term, having a large range of adjustment, which is easy to slip on and to take off by the user and suitable for professional or sporting use.

These objectives, and also others which will appear more clearly later on are achieved according to the invention with the help of a watch comprising at least one case which includes horns, at the level of a first side and of a second side opposite the first side, and a strap formed by a flexible blade with a first end fixed to the case and a second opposite end provided to cooperate with a device for attaching and adjusting the length of the strap.

According to the invention, the adjustment device comprises a clasp formed by a cap and a lever between which the flexible blade slides, the clasp being hinged on the case by linking means which define an axis of rotation about which the lever can undergo a rotation in order to be able to move into an open position and into a closed position, the lever comprising an eccentric, which is integral with the lever in the vicinity of the axis of rotation and is provided in order to clamp the free end of the blade against the cap and to retain the strap when the lever is in the closed position.

Hence, the subject of the present invention, by means of its various functional and structural aspects described above, makes it possible to obtain a watch which is easy to slip on and to adjust with respect to the morphology of the wearer.

According to other advantageous variants of the invention:

- the eccentric comprises a knurling over all or part of its surface;
- the eccentric comprises a toothing;

- the cap comprises lateral edges for guiding the flexible blade;
- the linking means comprise a lug or a slide;
- the clasp is produced in a metallic, plastic, ceramic material or even in a composite material;
- the strap blade is made of leather, rubber, textile or even a synthetic material.

BRIEF DESCRIPTION OF THE DRAWINGS

Other special features and advantages will emerge clearly from the description which is given hereafter, in an indicative and in no way limiting manner, with reference to the annexed drawings, in which.

DETAILED DESCRIPTION OF PREFERRED EMBODIMENTS

The watch according to the invention comprises at least one case 1 which includes horns, at the level of a first side and a second side opposite the first side, and a strap formed by a flexible blade 2 with a first end 20 fixed to the case 1 and a second opposite end 21 provided to cooperate with a device for attaching and adjusting the length of the strap.

Figure 1:
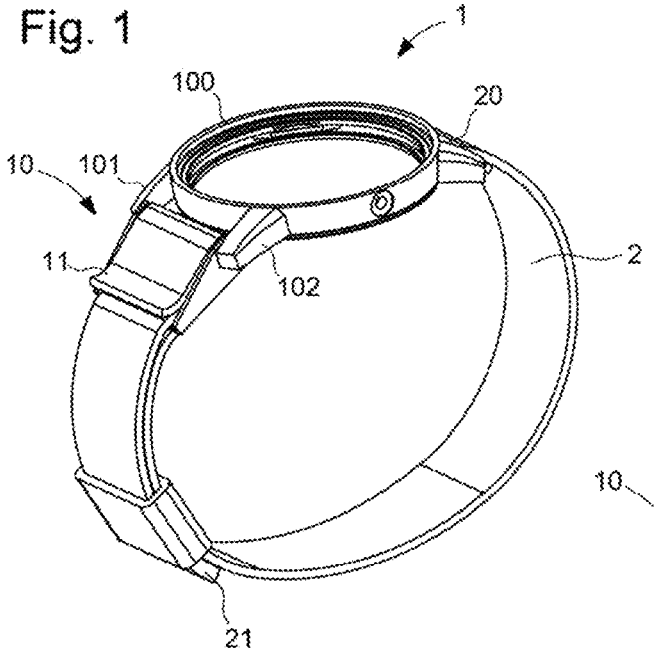
FIG. 1 illustrates a perspective view of a watch according to the invention according to a first embodiment.
Figure 2:
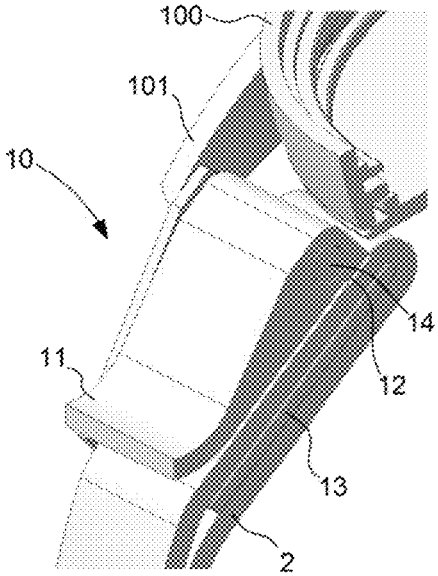
FIG. 2 represents a sectional view of the watch according to the invention illustrated in FIG. 1.
Figure 3:
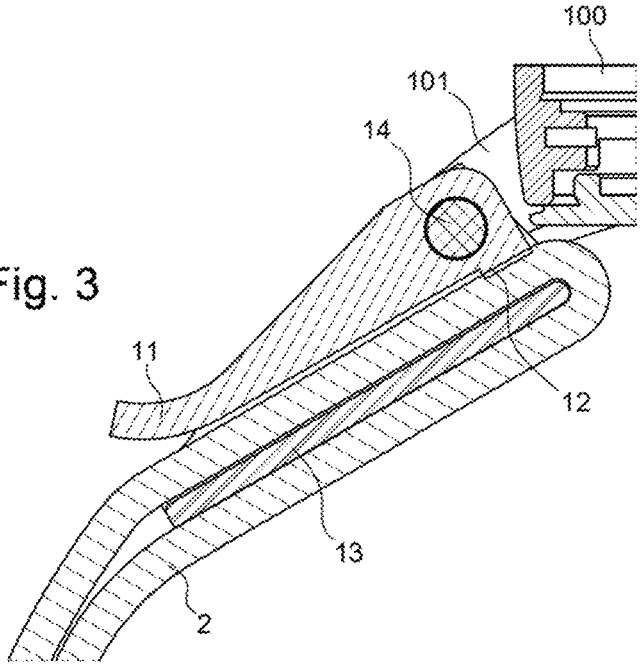
FIG. 3 represents a sectional view of the watch according to the invention illustrated in FIG. 1.

As represented in FIG. 1, the attachment and adjustment device according to the invention comprises a clasp formed by two elements, i.e. a lever 11 and a cap 13 between which the flexible blade 2 slides.

The clasp 10 is hinged on the case and the lever 11 can undergo a rotation in order to be able to move from an open position in which the flexible blade 2 is free to slide, towards a closed position in which the flexible blade is immobilised.

As represented in the Figures, the cap 13 has a substantially rectangular shape and comprises two lateral edges 130 and 131 which are disposed in the direction of the length in order to form a passage for the flexible blade 2.

Advantageously, the width of the blade 2 is slightly less than the width of the cap 13 in order to limit friction of the blade 2 against the lateral edges 130 and 131.

The lever 11 is hinged on the cap 13 by one of its ends, and has a transverse axis of rotation. Advantageously, this axis of transverse rotation coincides with the hinging of the clasp 10 on the case 1.

The clasp 10 can be hinged on the case 1 by means of linking means such as a lug 14, a slide or any other element which is able to retain the clasp 10 on the case 1, between the horns 101 and 102, whilst providing hinging which allows the lever 11 to pivot.

According to the invention, the lever 11 comprises an eccentric 14 which is integral with the lever 11, the eccentric 14 being disposed under the lever, in the vicinity of the axis of rotation. Such an eccentric 14 makes it possible to clamp the flexible blade 2 against the cap 13 and thus to immobilise the strap when the lever 11 is in the closed position.

According to a first embodiment of the invention, the eccentric 14 comprises, over all or part of its surface, a knurling in order to provide reliable immobilisation of the strap and to provide sliding of the latter.

According to another embodiment of the invention, the eccentric 14 comprises, over all or part of its surface, a toothing in order to immobilise the strap.

As can be observed in FIG. 1, the first end 20 of the blade 2 is integral with the case 1 at the level of a first side, between the horns, for example by means of a lug.

The second end 21 of the blade 2 moves between the cap 13 and the lever 11 in the open position.

When the wearer has adjusted the strap on his wrist, it suffices for him to lower the lever 11 in the direction of the cap 2. By means of this pivoting, the eccentric 14 clamps the strap and ensures its retention in the cap 13.

In order to loosen the blade 2, it suffices, to effect opening of the clasp, by lifting the lever 11.

The blade 2 forming the strap can be produced in leather, in rubber, in textile or even in a synthetic material. It can also be imagined that the second end 21 of the blade 2 comprises an excess thickness in order that the blade 2 cannot come out of the loop inadvertently.

The invention is therefore easy to handle with gloves, which can be necessary in the case of use when scuba diving for example.

The manufacturing cost thereof is very reasonable. The invention lends itself well to an exchange of the strap, as a function of use or aesthetic considerations.

Thanks to these various aspects of the invention, there is made available a watch of a simple design which makes it possible to adjust and lock the strap rapidly.

Of course, the present invention is not limited to the illustrated example but is able to have various variants and modifications which will be apparent to the person skilled in the art.

NOMENCLATURE

1. Watch,
10. Clasp,
11. Lever,
12. Eccentric,
13. Cap,
14. Lug,
2. Flexible blade,
20. First end of the flexible blade,
21. Second end of the flexible blade,
100. Case,
101, 102. Horns,
130, 131. Lateral edges of the cap.

What is claimed is:

1. A watch comprising:

at least one case which includes horns, the horns being positioned at the level of a first side and of a second side opposite the first side;

an adjustment device; and a strap formed by a flexible blade with a first end fixed to the case and a second opposite end, provided to cooperate with the adjustment device for attaching and adjusting the length of the strap, wherein the adjustment device includes a clasp formed by a cap and a lever between which the flexible blade is configured to slide, the cap includes two lateral edges extending in a longitudinal direction of the cap, the lateral edges being, disposed in a direction of a length of the flexible blade, wherein the clasp is hinged on the case by a linking means which define an axis of rotation about which the lever can rotate, wherein the lever includes a first portion and a second portion, each of the first portion and the second portion rotate about the axis of rotation when the lever is moved into an open position and into a closed position, wherein the second portion of the lever is comprised of an eccentric in the vicinity of the axis of rotation, the eccentric is integral the lever and the eccentric is closer to the flexible blade than the first portion of the lever is to the flexible blade, wherein the eccentric is configured to clamp the flexible blade against the cap so that the flexible blade is in contact with each of the eccentric and the cap so as to retain the flexible blade when the lever is in the closed position, when the lever is in the closed position, the first portion of the lever is adjacent to and extends along a length of the flexible blade such that a gap is provided between the first portion of the lever and the flexible blade so that the first portion of the blade is out of contact with the flexible blade, and wherein the clasp is hinged between the horns of the watch, the axis of rotation of the lever coincides with the hinging of the clasp between the horns of the watch.

2. The watch according to claim 1, in which said eccentric comprises a knurling over all or part of its surface.

3. The watch according to claim 1, in which said eccentric comprises a toothing.

4. The watch according to claim 1, in which the linking means comprise a lug or a slide.

5. The watch according to claim 1, in which the clasp is produced in a metallic, plastic, ceramic material or a composite material.

6. The watch according to claim 1, in which the flexible blade of the strap is made of leather, rubber, textile or a synthetic material.

7. The watch according to claim 1, wherein a width of the cap is larger than a width of the flexible blade.

* * * * *